United States Patent [19]

Matsuzaki et al.

[11] Patent Number: 4,537,159

[45] Date of Patent: Aug. 27, 1985

[54] COOLANT RESERVE TANK

[75] Inventors: Yoshitomi Matsuzaki, Hatano; Toshihiko Hayashi, Zama; Keizou Kushibiki, Hachioji, all of Japan

[73] Assignees: Nissan Motor Co., Ltd., Yokohama; Nihon Radiator Co., Ltd., Tokyo, both of Japan

[21] Appl. No.: 664,020

[22] Filed: Oct. 23, 1984

[30] Foreign Application Priority Data

Oct. 25, 1983 [JP] Japan ..... 58-164008[U]

[51] Int. Cl.[3] ..... F01P 11/02; B65D 51/16

[52] U.S. Cl. ..... 123/41.27; 220/203; 220/303; 220/374

[58] Field of Search ..... 123/41.27, 41.54; 220/202–205, 303, 373, 374

[56] References Cited

U.S. PATENT DOCUMENTS

| | | | |
|---|---|---|---|
| 1,615,757 | 1/1927 | Hamann | 123/41.27 |
| 2,076,031 | 4/1937 | Kane et al. | 123/41.27 |
| 3,741,172 | 6/1973 | Andreux | 123/41.54 |
| 3,820,593 | 6/1974 | Pabst | 123/41.54 |
| 4,285,440 | 8/1981 | Adams | 220/374 |
| 4,460,101 | 7/1984 | Tseng | 220/374 |

*Primary Examiner*—William A. Cuchlinski, Jr.
*Attorney, Agent, or Firm*—Schwartz, Jeffery, Schwaab, Mack, Blumenthal & Evans

[57] ABSTRACT

A coolant reserve tank comprises a disk-shaped splash-guard member horizontally disposed adjacent an inner end of a coolant reserve chamber vent and having in the upper surface thereof a plurality of grooves only through which the vent opens into the coolant reserve chamber, whereby the waves of the coolant in the chamber are mostly dashed against the lower surface of the splash-guard member and prevented from dashing into the vent to leak out therethrough.

13 Claims, 10 Drawing Figures

COOLANT RESERVE TANK

BACKGROUND OF THE INVENTION

1. Field of the Invention

The present invention relates in general to cooling systems of water-cooled engines and more particularly to an expansion tank or coolant reserve tank connected to the top of a radiator to act as an expansion chamber as well as to provide an additional capacity.

2. Description of the Prior Art

As is well known in the art and shown in FIGS. 1 and 2, a coolant reserve tank 10 is connected through a pipe 12 to the top tank 14*a* of a radiator 14 so that, when the coolant in the radiator 14, cylinder block and their connections (neither shown) reaches a predetermined temperature, the coolant expands into the reserve tank 10 and, when the coolant temperature falls, it flows back into the ordinary cooling system, whereby to always fill the radiator 14 with coolant.

The coolant reserve tank 10 has a cap 10*a* formed with a hole or vent 10*b* which opens the tank 10 to the atmosphere for releasing therethrough the vapour produced in the tank 10 and making the pressure in the tank 10 equivalent to the atmospheric pressure. Various forms of such a vent are known in the art. For example, as shown in FIGS. 3 and 4, a vent 16*a* may be formed adjacent the top of a tank 16 or a vent 18*a* may be formed by a pipe 18 which passes through a cap 20.

The disadvantage of the prior art coolant reserve tank having such a vent is that during running of the vehicle, particularly on a rough road, the coolant in the reserve tank may be waved greatly and dashed or splashed into the vent to leak therethrough, possibly causing various problems such as a deteriorated cooling efficiency due to an insufficient amount of coolant, a deteriorated insulation of some electrical system which is wetted by a leaked-out coolant, and so on.

SUMMARY OF THE INVENTION

In accordance with the present invention, there is provided an improved coolant reserve tank which comprises as usual a tank main body having a coolant reserve chamber, means for defining a coolant conveying passage for conveying coolant to and from a radiator and means for defining a coolant reserve chamber vent having a first end disposed inside the chamber at a location adjacent the top of same and a second end disposed outside the chamber and opening to the atmosphere.

In accordance with the present invention, a splash-guard member is disposed inside the coolant reserve chamber at a location adjacent the first end of the vent and having a sideway passage which extends in a plane normal to the top-to-bottom directions of the tank main body and only through which the first end of the vent opens to the chamber.

The above structure is quite effective for preventing the coolant from leaking out through the vent and thereby eliminating the disadvantages noted above.

It is accordingly an object of the present invention to provide an improved coolant reserve tank which can eliminate the disadvantages noted above.

It is another object of the present invention to provide an improved coolant reserve tank of the foregoing character which can effectively prevent the coolant in the tank from leaking out through a vent.

It is a further object of the present invention to provide an improved coolant reserve tank of the foregoing character which is simple in structure but reliable in operation.

It is a yet further object of the present invention to provide an improved coolant reverse tank of the foregoing character which is easy in installation.

BRIEF DESCRIPTION OF THE DRAWINGS

The features and advantages of the coolant reserve tank according to the present invention will become more clearly appreciated from the following description taken in conjunction with the accompanying drawings, in which.

DETAILED DESCRIPTION OF THE PREFERRED EMBODIMENT

Figure 1:
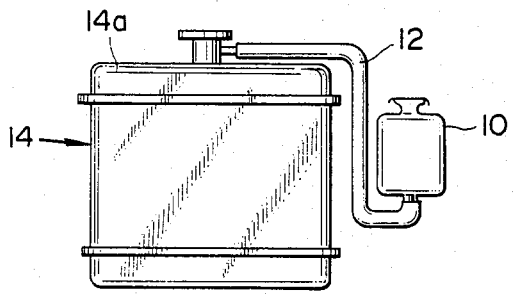
FIG.1 (PRIOR ART)
FIG. 1 is a schematic view of a prior art cooling system of a water-cooled engine.
Figure 2:
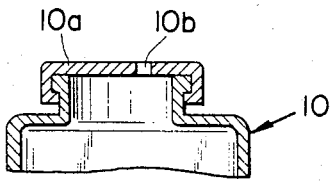
FIG.2 (PRIOR ART)
FIG. 2 is a fragmentary view of a coolant reserve tank incorporated in the cooling system of FIG. 1.
Figure 3:
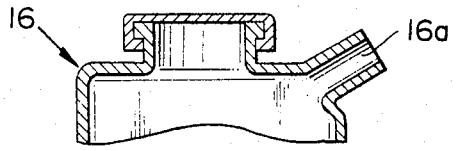
FIG.3 (PRIOR ART)
FIGS. 3 and 4 are views similar to FIG. 2 but showing different forms of the prior art coolant reserve tank.
Figure 4:
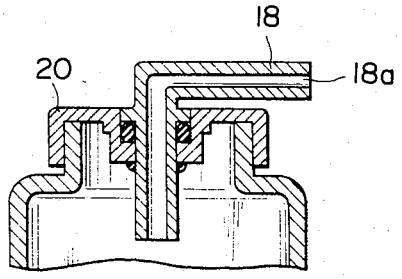
FIG.4 (PRIOR ART)
Figure 5:
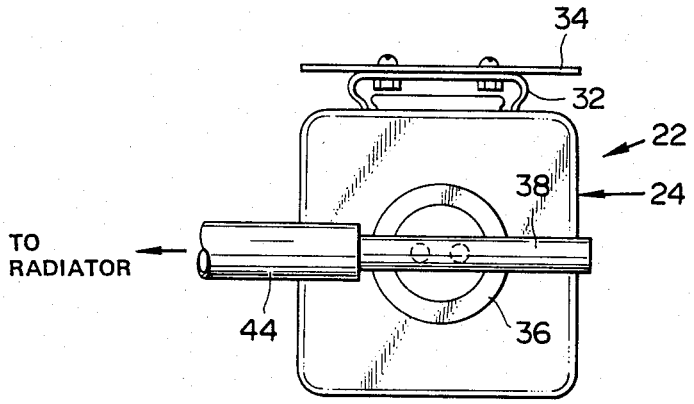
FIG. 5 is a top plan view of a coolant reserve tank according to the present invention.
Figure 6:
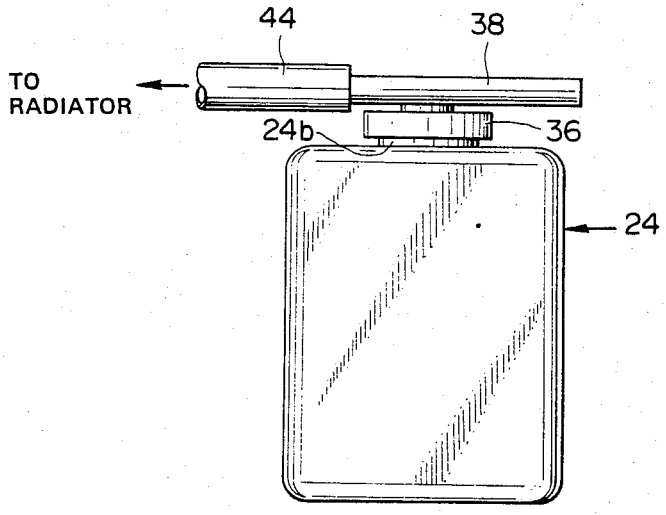
FIG. 6 is a side elevational view of the coolant reserve tank of FIG. 5.
Figure 7:
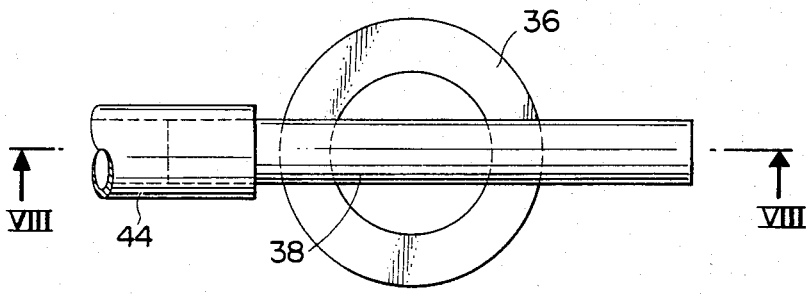
FIG. 7 is a top plan view of a cap and its adjacent parts incoporated in the coolant reserve tank of FIG. 5.
Figure 8:
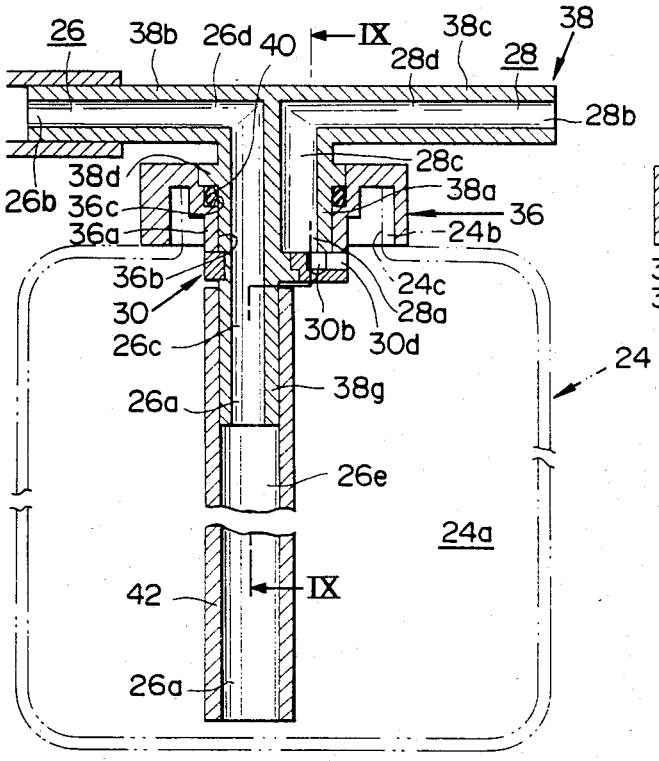
FIG. 8 is a sectional view taken along the line VIII—VIII of FIG. 7.
Figure 9:
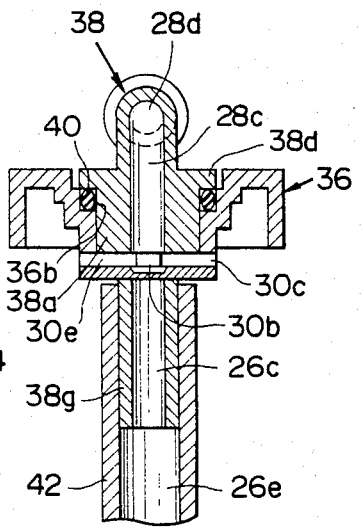
FIG. 9 is a sectional view taken along the line IX—IX of FIG. 8.
Figure 10:
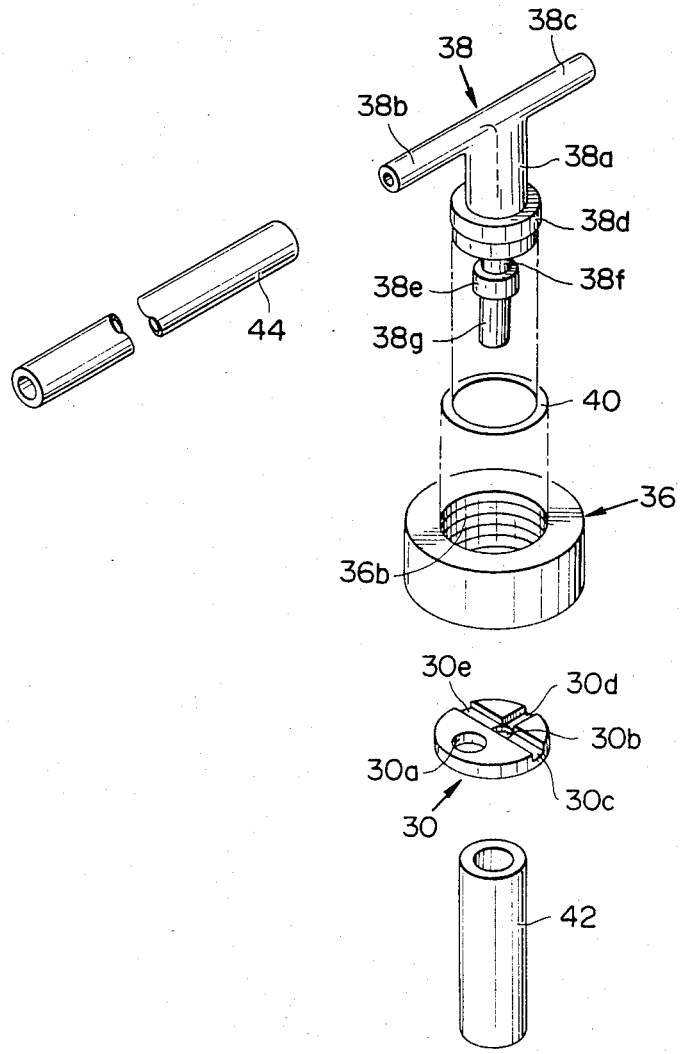
FIG. 10 is an exploded view of the cap and its adjacent parts of FIGS. 7 to 9.

Referring to FIGS. 5 through 10, inclusive, a coolant reserve tank according to the present invention is generally designated by the reference numeral 22 and shown as comprising a tank main body 24 having a coolant reserve chamber 24*a* for holding therein coolant, a coolant conveying passage 26 having a first end 26*a* disposed inside the chamber 24*a* at a location adjacent the bottom of same and a second end 26*b* disposed outside the chamber 24*a* and communicating a top tank of a radiator (refer to FIG. 1), a coolant reserve chamber vent 28 having a first end 28*a* disposed inside the chamber 24*a* at a location adjacent the top of same and a second end 28*b* disposed outside the chamber 24*a* and opening to the atmosphere, and a splash-guard member 30 disposed inside the chamber 24*a* at a location adjacent the first end 28*a* of the vent 28 and having a sideway or horizontal passage only through which the first end 28*a* of the vent 28 opens to the coolant reserve chamber 28.

More specifically, the tank main body 24 in this embodiment has a rectangular configuration and is provided on one vertical side thereof with a bracket 32 through which it is screwed onto a vehicle body panel 34 adjacent the radiator (not shown). The tank main body 24 has at its top end a circular neck portion 24*b* and an upper circular opening 24*c* formed therein in a manner to communicate the coolant reserve chamber 24*a*. An annular cap 36 is fitted on the neck portion 24*b* to partially cover the upper opening 24*c* and has a central sleeve 36*a* extending into same. The cap 36 is formed at the central sleeve 36*a* with a central hole 36*b* which is stepped to provide an annular shoulder 36*c*.

The aforementioned coolant conveying passage 26 is angled to have an L-like shape and consists of a first passage section 26c extending vertically or in the top-to-bottom directions of the tank main body 24 and a second passage section 26d extending horizontally or normal to the first passage section 26c to be connected to the upper end of same. The coolant conveying passage 26 further has a vertical extension passage section 26e extending downwardly from the lower end of the first passage section 26c to terminate in the aforementioned first end 26a thereof.

The aforementioned coolant reserve chamber vent 28 is also angled to have an L-like shape and consists of a first passage section 28c extending parallel with the first passage section 26c of the coolant conveying passage 26 and a second passage section 28d axially aligned with the second passage section 26d of the coolant conveying passage 26 and extending in the direction opposite to same.

The vent 28 and the first and second passage sections 26c and 26d of the coolant conveying passage 26 are formed by a common T-shaped pipe 38. The pipe 38 is a single piece and has a vertical or upstanding body portion 38a in which the first passage sections 26c and 28c are formed and a pair of horizontal arms 38b and 38c in which the second passage sections 26d and 28d are formed. The body portion 38a of the pipe 38 has a generally circular cross section and is formed with an annular peripheral flange 38d. The T-shaped pipe 38 is fitted at the body portion 38a in the central hole 36b of the cap 36, with the arms 38b and 38c being disposed outside the tank main body 24 and a sealing member 40 being interposed between the shoulder 36c and the flange 38d to provide a seal between the cap 36 and the pipe 38.

The T-shaped pipe 38 further has a leg 38e extending downwardly from the lower end of the body portion 38a. The leg 38e is arranged eccentric with the body portion 38a and in which the lower part of the first passage section 26c of the coolant conveying passage 26 is formed. The leg 38e is circular in cross section and has at the upper end thereof with an annular peripheral groove 38f and at the lower end thereof a reduced diameter portion 38g.

The aforementioned splash-guard member 30 is in the form of a disk and has an eccentric opening 30a at which it is fitted in the groove 38f of the pipe 38 for thereby being installed thereon and positioned horizontally. In this connection, the splash-guard member 30 is adapted to engage the lower end of the central sleeve 36a of the cap 36 to prevent the downward movement of the cap 36 relative to the pipe 38, while the flange 38d and the sealing member 40 cooperate with the shoulder 36c of the cap 36 to restrict the upward movement of the cap 36 relative to the pipe 38. The splash-guard member 30 is therefore adapted to axially hold the pipe 38 on the cap 36 while allowing the relative rotation between the pipe and the cap when fitted in the groove 38f. The splash-guard member 30 further has in the upper surface thereof a blind hole 30b connected to the first end 28a of the vent 28 and a plurality of radial grooves 30c, 30d and 30e (three in this embodiment) each of which is connected at an end to the blind hole 30b and extends away therefrom to terminate in the periphery of the disk-shaped splash-guard member 30. In this connection, it is to be noted that the blind hole 30b and the grooves 30c, 30d and 30e are formed in the upper surface of the horizontal splash-guard member 30.

The reduced diameter portion 38g of the leg 38e is adapted to project downwardly from the splash-guard member 30 when the member 30 is installed on the pipe 38. A hose 42 is fitted on the reduced diameter portion 38g of the leg 38e and extends downwardly therefrom to form the aforementioned extension passage section 26e of the coolant conveying passage 26.

The arm 38b of the T-shaped pipe 38 is connected through a hose 44 to the top tank of the radiator as is conventional and shown in FIG. 1.

In use, when the coolant in the radiator, cylinder block and its connections reaches a predetermined temperature, it expands into the tank main body 24 through the hose 44 and the coolant conveying passage 26 formed in the pipe 36 and the hose 42, while the coolant reserve chamber 24a is vented to the atmosphere through the grooves 30c, 30d and 30e and the blind hole 30b formed in the upper surface of the splash-guard member 30 and through the coolant reserve chamber vent 28 formed in the pipe 36. When the coolant temperature falls, the coolant flows back into the radiator or the ordinary cooling system.

When the coolant in the tank main body 24 is caused to wave greatly upon running of the vehicle on a rough road, the waves of the coolant are mostly dashed against the lower surface of the splash-guard member 30 and can scarecely get into the grooves 30c, 30d and 30e through their open ends at the periphery of the splash-guard member 30. Furthermore, even if a certain amount of coolant dashes into the grooves 30c, 30d and 30e, the force of the dashing coolant is broken or weakened by the upstanding first passage section 28c of the coolant reserve chamber vent 28 so that the coolant cannot leak out through the vent 28. By the provision of the splash-guard member 30, the coolant in the tank main body 24 is therefore assuredly prevented from leaking out through the vent 28.

The T-shaped pipe 38 is installed rotatable relative to the cap 36. This is convenient for connecting the pipe 36 to the hose 44 leading from the top tank of the radiator.

What is claimed is:

1. A coolant reserve tank comprising:

a tank main body having a coolant reserve chamber;

means for defining a coolant conveying passage for conveying coolant to and from a radiator;

means for defining a coolant reserve chamber vent having a first end disposed inside said chamber at a location adjacent the top of same and a second end disposed outside said chamber and opening to the atmosphere; and a splash-guard member disposed inside said chamber at a location adjacent said first end of said vent and having a sideway passage which extends in a plane normal to the top-to-bottom directions of said tank main body and only through which said first end of said vent opens to said chamber.

2. A coolant reserve tank comprising:

a tank main body having a coolant reserve chamber;

means for defining a coolant conveying passage having a first end disposed inside said chamber at a location adjacent the bottom of same and a second end disposed outside said chamber and communicating a radiator;

means for defining a coolant reserve chamber vent having a first end disposed inside said chamber at a location adjacent the top of said chamber and a second end disposed outside said chamber and opening to the atmosphere; and a splash-guard member having a horizontal passage only through which said first end of said vent opens to said chamber.

3. A coolant reserve tank as set forth in claim 2, in which said tank main body having at the top end thereof a circular neck portion and an upper circular opening formed therein in a manner to communicate said coolant reserve chamber.

4. A coolant reserve tank as set forth in claim 3, further comprising an annular cap fitted on said neck portion to partially cover said upper opening and having a central sleeve extending into same, said cap being formed at said central sleeve with a central opening which is stepped to provide an annular shoulder.

5. A coolant reserve tank as set forth in claim 4, in which said coolant conveying passage is angled to have an L-like shape and consists of a first passage section extending vertically and a second passages section extending horizontally, said coolant conveying passage further having a vertical extension passage section extending downwardly from the lower end of said first passage section to terminate in said first end thereof, in which said coolant reserve chamber vent is also angled to have an L-like shape and consists of a first passage section extending parallel with said first passage section of said coolant conveying passage and a second passage section axially aligned with said second passage section of said coolant conveying passage and extending in the direction opposite to same, and in which said coolant conveying passage defining means and said coolant reserve chamber vent defining means are partially combined to comprise a single-piece T-shaped pipe having a vertical body portion in which said first passage sections of said coolant conveying passage and said coolant reserve chamber vent are formed and a pair of horizontal arm portions in which said second passage sections of said coolant conveying passage and said coolant reserve chamber vent are formed, said body portion of said pipe having a generally circular cross section, said pipe being fitted at said body portion in said central hole of said cap with said arm portions being disposed outside said tank main body.

6. A coolant reserve tank as set forth in claim 5, in which said body portion of said pipe is formed with an annular peripheral flange which cooperates with said shoulder to interpose therebetween a sealing member which provides a seal between said cap and said pipe.

7. A coolant reserve tank as set forth in claim 6, in which said T-shaped pipe further has a leg extending downwardly from the lower end of said body portion, said leg being arranged eccentric with said body portion and in which the lower part of said first passage section of said coolant conveying passage is formed.

8. A coolant reserve tank as set forth in claim 7, in which said leg is circular in cross section and has at the upper end thereof an annular peripheral groove and at the lower end thereof a reduced diameter portion.

9. A coolant reserve tank as set forth in claim 8, in which said splash-guard member is in the form of a disk and has an eccentric opening at which it is fitted in said groove of said leg for thereby being installed thereon and positioned horizontally.

10. A coolant reserve tank as set forth in claim 9, in which said splash-guard member engages the lower end of said central sleeve of said cap and cooperates with said flange of said body portion of said pipe to axially hold therebetween said cap while allowing the relative rotation between said pipe and said cap.

11. A coolant reserve tank as set forth in claim 10, in which said splash-guard member has in the upper surface thereof a blind hole connected to said first end of said coolant reserve chamber vent and a radial groove which is connected at an end to said blind hole and extends away therefrom to terminate in the periphery of said splash-guard member, said groove of said splash-guard member constituting said horizontal passage of same.

12. A coolant reserve tank as set forth in claim 11, in which said splash-guard member comprises a plurality of said grooves.

13. A coolant reverse tank as set forth in claim 12, further comprising a hose fitted on said reduced diameter portion of said leg and extending downwardly therefrom to form said extension passage section of said coolant conveying passage.

* * * * *